US006496989B1

(12) United States Patent
Meiser

(10) Patent No.: US 6,496,989 B1
(45) Date of Patent: Dec. 24, 2002

(54) TOILET DEVICE THAT CAN BE TRANSFORMED INTO A URINAL

(76) Inventor: Detlef Meiser, Sanddornweg 14, D-19073 Wiltenfórden (DE)

( * ) Notice: Subject to any disclaimer, the term of this patent is extended or adjusted under 35 U.S.C. 154(b) by 0 days.

(21) Appl. No.: 09/889,767

(22) PCT Filed: Jan. 17, 2000

(86) PCT No.: PCT/EP00/00285

§ 371 (c)(1),
(2), (4) Date: Jul. 19, 2001

(87) PCT Pub. No.: WO00/43603

PCT Pub. Date: Jul. 27, 2000

(30) Foreign Application Priority Data

Jan. 19, 1999 (DE) ..... 199 01 844
Mar. 4, 1999 (DE) ..... 299 03 954 U

(51) Int. Cl.[7] ..... E03D 11/00

(52) U.S. Cl. ..... 4/420; 4/252.1; 4/252.3; 4/307; 4/312; 4/DIG. 2

(58) Field of Search ..... 4/252.1–252.6, 4/307, 310, 311, 312, 420, DIG. 2, DIG. 13, DIG. 16

(56) References Cited

U.S. PATENT DOCUMENTS

| | | | | |
|---|---|---|---|---|
| 2,678,450 A | | 5/1954 | Simpson et al. | |
| 4,174,546 A | | 11/1979 | Ohtake | |
| 4,726,079 A | | 2/1988 | Signori et al. | |
| 4,944,047 A | * | 7/1990 | Gagliano | 4/307 |
| 5,257,422 A | | 11/1993 | Riiegg | |

FOREIGN PATENT DOCUMENTS

| | | |
|---|---|---|
| DE | 93 09 702.6 | 12/1993 |
| FR | 2 480 825 | 10/1981 |
| JP | 3-158535 | 7/1991 |
| WO | 99/23319 | 5/1999 |

* cited by examiner

*Primary Examiner*—Gregory Huson
*Assistant Examiner*—Tuan Nguyen
(74) *Attorney, Agent, or Firm*—Herbert Dubno; Andrew Wilford

(57) ABSTRACT

A toilet device comprising a toilet bowl which is provided with a seat, a flushing water inlet and an outlet for waste water. The toilet bowl is installed at a predetermined level above the floor. The distance and the position of the toilet bowl can be changed in relation to the floor by means of a device. The comfortable toilet device can also be used as urinal in a hygienic manner and can be equally used by different sized person, i.e. adults and children.

7 Claims, 4 Drawing Sheets

TOILET DEVICE THAT CAN BE TRANSFORMED INTO A URINAL

Figure 1:
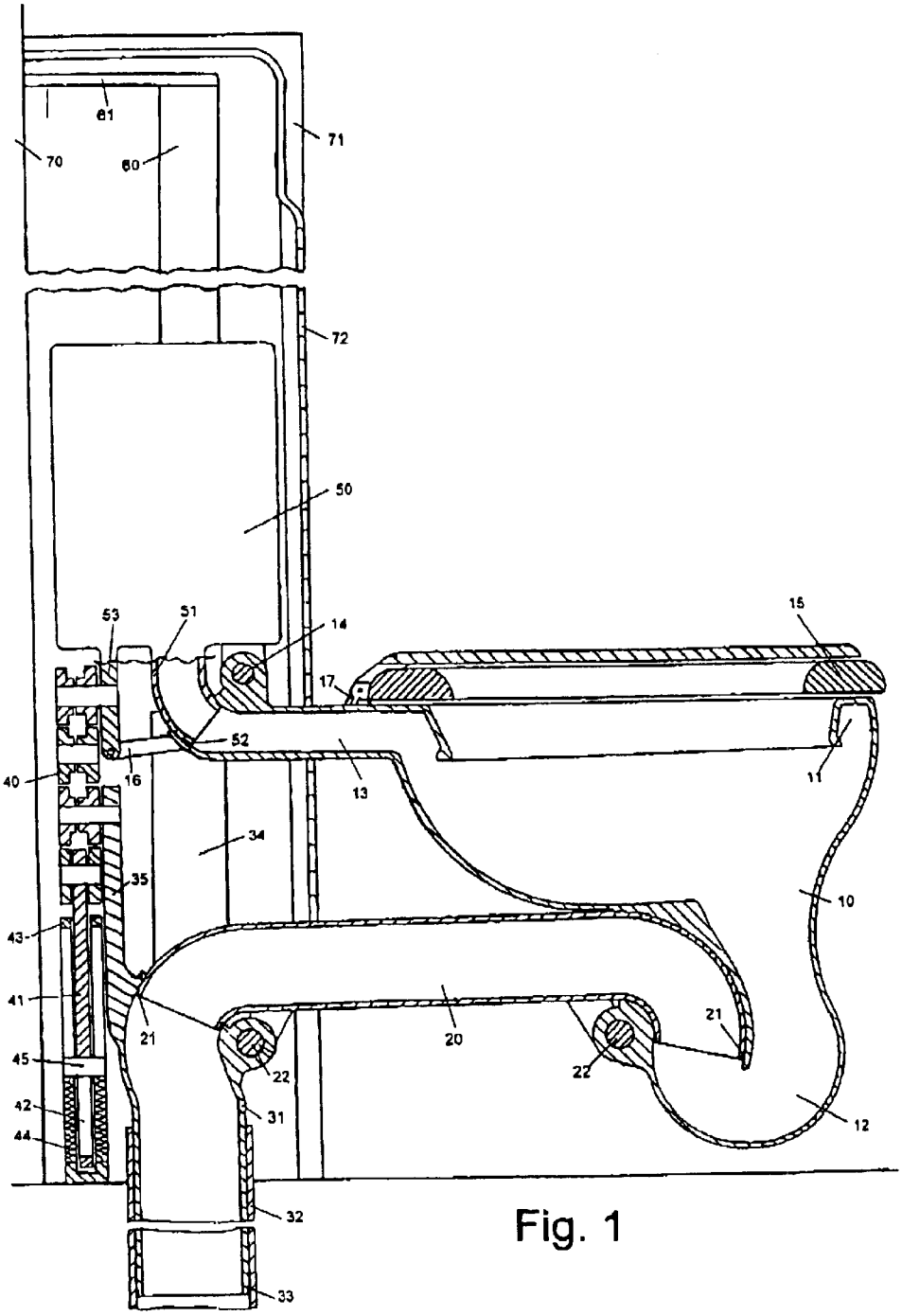

The invention relates to a toilet device with a bowl having a seat, an inlet for flush water and an outlet for waste water, wherein a device is provided which allows the lifting and tilting of the bowl in a direction towards the user into an ordinary position of the urinal.

A toilet device of this type is known from document D1 (=JP-A-03158535). D1 describes a toilet device with a bowl 6 equipped with a seat 7 having an inlet aperture for flush water and an outlet aperture for waste water (see FIGS. 1, 3–7), wherein the bowl is height adjustable (see FIG. 7), and wherein an adjustment to an ordinary urinal is provided (see FIG. 4) by an additional tilting to the front (see FIG. 1).

The latter toilet device has the disadvantage that the removal of the waste water is achieved by a hose coupling. Rapid clogging and soiling can be expected for such a solution, since the hose couplings in general do not feature smooth and straight surfaces. The detached adjusting elements are a further disadvantage of this toilet device, because the adjustment of the toilet device leads to a risk of injury.

It is an object of the invention to provide a toilet device of the above-mentioned type wherein the waste water device 12, 20, 31, 32 ensures a safe draining of the waste water in every position of the bowl 10, whereby the water level in the drain trap 12 is kept on its position, and which efficiently enables a lifting and tilting of the bowl 10 by simple means.

For a toilet device of the above-mentioned type, the latter object is solved by connecting the waste water outlet to a U-shaped articulated tube 20 being uniformly bended at both ends, the front end of which is telescopically connected via a drag bearing 22 in a flexible manner to the drain trap 12 being uniformly bended at its end, and the back end of which is telescopically connected via a drag bearing 22 in a flexible manner to the uniformly bended beginning of the vertical waste pipe 31, 32 for the drain of waste water.

It is one advantage of the toilet device according to the invention that the waste water is discharged via tubes whereby the likelihood of soiling and clogging of the waste water outlets is not larger than with conventional toilet devices. The latter embodiment ensures that even during a permanent loading with waste water the water level in the drain trap 12 is retained on the same level in any position of the bowl, thereby preventing a smell annoyance.

Preferred embodiments of the invention are subject matter of the dependent claims.

The preferred embodiment of the toilet device according to claim 2 of the present invention enables the inflow of flush water in every position of the bowl 10.

In the preferred embodiment of the toilet device according to claim 3 of the present invention the U-shaped articulated tube 20 in combination with the support structure 13 constitute the load-bearing and guiding elements of the bowl 10.

Therein, the device for adjusting, e.g. enlarging, the vertical distance of the drag bearing 14 at the flush water tube 13 to the drag bearing 22 at the waste pipe 31, 32 being in a vertical position during use, is realized in a way which permits a lifting and tilting of the bowl 10 to an ordinary position of the urinal.

By using a toilet device according to the present invention, the device 30, 34, 40, 60 for lifting and tilting of the bowl, the scouring pipe 51, and the vertical waste pipe 31, 32 can be placed behind a facing wall 71, so that the bowl in the default position optically resembles the appearance of a wall-hung toilet.

The device for lifting and tilting of the bowl may be realized in a way which allows the moving of the bowl via electromagnetic devices of via hydraulic devices. When using a hydraulic device, it is in particular advantageous to use the existing pressure of the water conduit for lifting and tilting of the bowl.

The provision of the device 30, 34, 40, 60 for lifting and tilting of the bowl also allows an adjustment of the sitting height of the bowl or the height of the tilted bowl used as a urinal.

The device 30, 34, 40, 60 for lifting and tilting of the bowl enables the use of the toilet device according to the present invention as a device facilitating the standing up of respective disabled persons.

The toilet device according to the invention is illustrated below by a preferred embodiment which is represented in the figures of the drawings. Therein, it is shown in:

FIG. 1 a preferred embodiment of the toilet device according to the invention in a cross-sectional side view.

Figure 2:
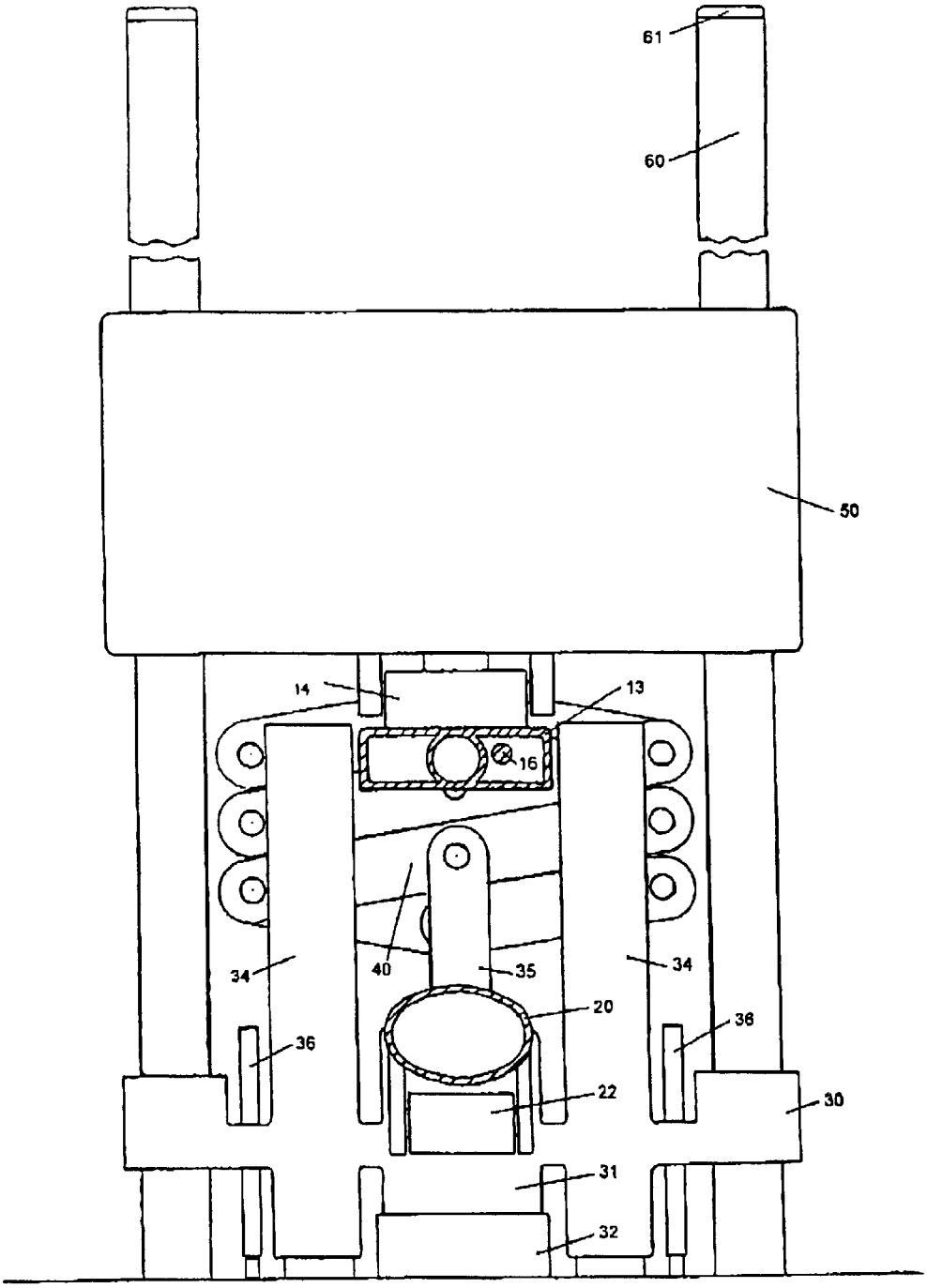

FIG. 2 a preferred embodiment of the adjustment device of the toilet device according to the invention in a front view.

Figure 3:
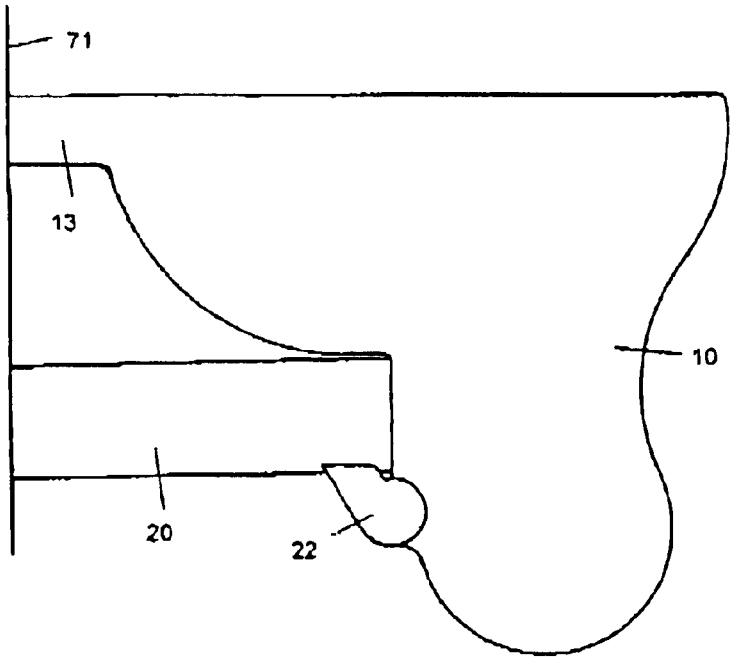

FIG. 3 the embodiment of the toilet device according to the invention shown in FIGS. 1 and 2 in a side view.

Figure 4:
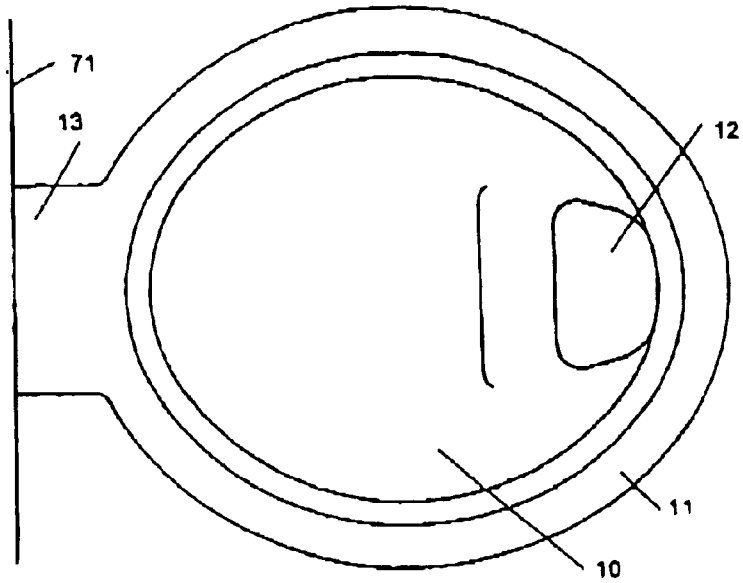

FIG. 4 the embodiment of the toilet device according to the invention shown in FIGS. 1 and 2 in a top view.

Figure 5:
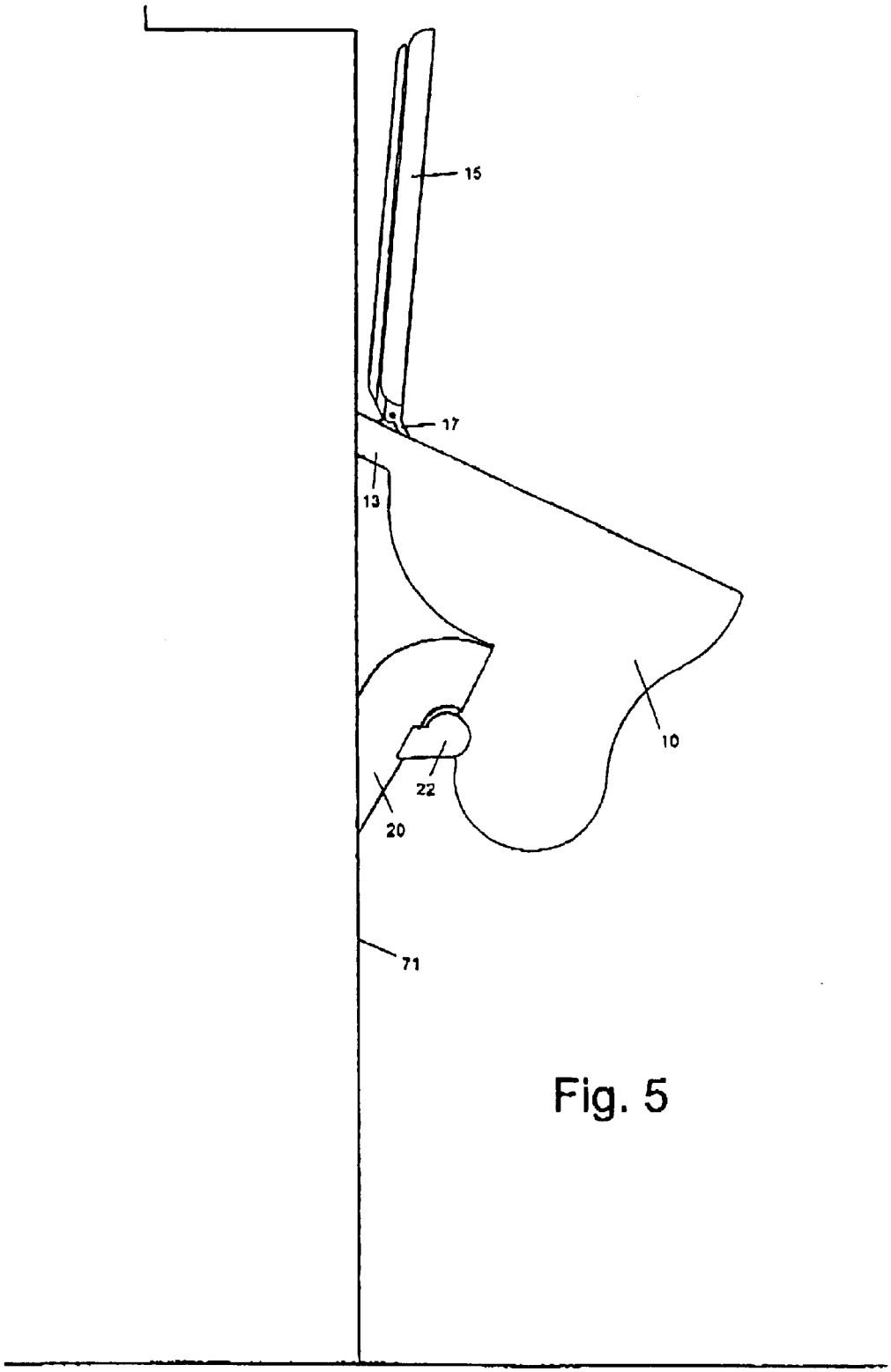

FIG. 5 the embodiment of the toilet device according to the invention shown in FIGS. 1 to 4 in a side view of the urinal position.

The toilet device illustrated in FIGS. 1 to 5 fulfils the features height adjustment and tilting to a urinal, adjustment of the sitting height of the bowl, height adjustment of the bowl tilted to a urinal and the use for facilitating die standing up of respective disabled people. The adjustment of the toilet device is performed by using the existing pressure of the water conduit. The connection of the hydraulic cylinders with the valves and of the toilet tank with the water conduit is accomplished through flexible hose connections.

By operating a valve, water is introduced into the hydraulic cylinders 34. The console 30 is lifted along the guide bars 60 forming a track by the extending pistons, whereby the vertical waste pipe 31, 32 being connected to the console 30 is concurrently pulled out, thus leading to an enlargement of the distance of the bowl 10 to the floor. Concomitantly, the scissor system 40 is lifted with the pulling bracket 41 via the carrier 35. After reaching the height defined. by the slot 42, the pulling bracket 41 catches the bolt 45 pre-stressed by the tension strings 44. By further extending the pistons of the hydraulic cylinders 34, the scissor system 40 is deflected via the carrier 35. The latter leads to an enlargement of the distance of the drag bearing 14 at the flush water tube 13 to the drag bearing 22 at the waste pipe 31, 32 being in a vertical position during use. Thereby, the toilet bowl is brought via the drag bearings 14 and 22 into a sloping position tilted towards the user. The tension strings 44 allow a further elevation of the pre-tilted urinal. By tilting the toilet bowl 10, the slide 16 pushes upon the lever 17 leading to an automatic opening or closing of the toilet seat, respectively.

During the tilting of the bowl 10 into a sloping position, the U-shaped articulated tube 20 being uniformly bended on both ends is, guided by the drag bearings 22, pulled on its front end out of the drain trap 12 being uniformly bended at its end, and simultaneously the back end of the articulated tube 20 is inserted deeper into the vertical waste pipe 31, 32 being uniformly bended at its beginning. This construction ensures that the drain to the waste water system is preserved during the load with excrements or liquids and that the water level in the drain trap 12 is retained. Concomitantly, the scouring pipe 51 being uniformly bended at its end and guided by the drag bearing 14, is inserted deeper into the supporting structure 13 being uniformly bended at its beginning. For descending the toilet device, a further valve is opened which connects the hydraulic cylinders 34 with the toilet tank. The bowl 10 descends by its own weight and thereby pushes the water from the hydraulic cylinders 34 into the toilet tank 50 where it can be used for ordinary flushing.

For flushing, water which is stored in the toilet tank 50 is discharged via the scouring pipe 51 and the supporting structure with flush water flow 13, whereby water flows into the rinsing channel 11 of the bowl 10. The water is distributed accordingly in the rinsing channel and cleans the bowl 10. The initiation of the flush process may also be triggered by a valve which is controlled by the descending bowl 10.

List of Reference Numbers

10 bowl
11 rinsing channel
12 drain trap
13 supporting structure (with flush water flow)
14 drag bearing
15 toilet seat
16 slide
17 lever
20 U-shaped articulated tube
21 sealing
22 drag bearing
30 console (with guide bushes)
31 vertical waste pipe (inside)
32 vertical waste pipe (outside)
33 sealing
34 hydraulic cylinder with plunger (eventually step piston)
35 carrier
36 bit stop (adjustable)
40 scissor system (1:2)
41 pulling bracket (with)
42 slot
43 retaining trestle
44 tension string
45 bolt
50 toilet tank (with integrated guide bushes)
51 scouring pipe
52 scaling
53 bracket
60 guide support
61 pipe hook
70 raw wall
71 facing wall (with outlet for scouring and waste pipes)
72 window shade

What is claimed is:

1. A toilet device with a bowl (10) equipped with a seat (15) having an inlet aperture for flush water and an outlet aperture for waste water, wherein a device (30, 34, 40, 60) is provided which allows a lifting and tilting of the bowl in a direction toward the user into an ordinary position of a urinal, characterized in that the waste water outlet is connected to a U-shaped articulated tube (20) being uniformly beaded at both ends, wherein the front end of the articulated tube (20) is telescopically connected via a drag bearing (22) in a flexible manner to a uniformly bended end of a drain trap (12), and wherein the back end of the articulated tube (20) is telescopically connected via a drag bearing (22) in a flexible manner to a uniformly bended beginning of a waste pipe (31, 32) being vertical during use for the outflow of waste water.

2. The toilet device according to claim 1, characterized in that the inlet aperture is connected via a supporting structure (13) to a uniformly bended end of a scouring pipe (51), wherein said end of the scouring pipe is telescopically connected via a drag bearing (14) to the uniformly bended beginning of the supporting structure (13) in a flexible manner for the inflow of flush water.

3. The toilet device according to claim 1, characterized in that the supporting structure (13) being flexibly connected to the scouring pipe (51) via the drag bearing (14), constitute the load-bearing and guiding elements of the bowl (10).

4. The toilet device according to claim 1, characterized in that an increase of the distance between a first drag bearing (14) at a scouring pipe (13) and a second drag bearing (22) at the waste pipe (31, 32) enables the lifting and tilting of the bowl into the urinal position.

5. The toilet device according to claim 1, characterized in that a facing wall (71) with an outlet for a supporting structure (13) and the articulated tube (20) is provided between the bowl (10) and the waste pipe (31, 32) and the scouring pipe (51) so that the bowl in use would visually resemble a wall-hung toilet.

6. The toilet device according to claim 1, characterized in that the lifting and tilting of the bowl can be performed hydraulically.

7. The toilet device according to claim 1, characterized in that the bowl is being used for facilitating the standing up of disabled persons.

* * * * *